US009561157B2

(12) United States Patent
Knight et al.

(10) Patent No.: US 9,561,157 B2
(45) Date of Patent: Feb. 7, 2017

(54) TEAT FOR A FEEDING BOTTLE

(75) Inventors: Simon Christopher Knight, Cambridge (GB); Carolien Willemijn Geijzendorffer, Mussel (NL); Michael Van Den Bosch, Drachten (NL); Johannes Tseard Van Der Kooi, Hurdegaryp (NL)

(73) Assignee: KONINKLIJIKE PHILIPS N.V., Eindhoven (NL)

( * ) Notice: Subject to any disclaimer, the term of this patent is extended or adjusted under 35 U.S.C. 154(b) by 28 days.

(21) Appl. No.: 13/992,469

(22) PCT Filed: Dec. 8, 2011

(86) PCT No.: PCT/IB2011/055538

§ 371 (c)(1),
(2), (4) Date: Jan. 20, 2014

(87) PCT Pub. No.: WO2012/085727

PCT Pub. Date: Jun. 28, 2012

(65) Prior Publication Data

US 2014/0217053 A1 Aug. 7, 2014

(30) Foreign Application Priority Data

Dec. 20, 2010 (EP) ..... 10195860

(51) Int. Cl.
*A61J 11/00* (2006.01)
*A61J 11/04* (2006.01)

(52) U.S. Cl.
CPC ..... *A61J 11/0045* (2013.01); *A61J 11/006* (2013.01); *A61J 11/04* (2013.01)

(58) Field of Classification Search
CPC ..... A61J 11/0045; A61J 11/006; A61J 11/04
USPC ..... 215/11.1, 11.2, 11.3, 11.4, 11.5, 11.6; 29/235.5; 248/102, 104
See application file for complete search history.

(56) References Cited

U.S. PATENT DOCUMENTS

| | | | | |
|---|---|---|---|---|
| 605,161 | A | 6/1898 | Clement et al. | |
| 1,146,639 | A | 7/1915 | Miller | |
| 1,573,519 | A | 2/1926 | Little | |
| 2,517,457 | A | 8/1950 | Allen | |
| 2,588,069 | A | 3/1952 | Allen | |
| 2,956,702 | A | 10/1960 | Ransom | |
| 4,505,398 | A * | 3/1985 | Kesselring | 215/11.5 |
| 5,114,374 | A * | 5/1992 | Estiva | 446/77 |
| 5,544,766 | A * | 8/1996 | Dunn | A61J 11/001 206/459.5 |
| 5,553,726 | A | 9/1996 | Park | |
| 6,032,810 | A | 3/2000 | Meyers et al. | |

(Continued)

FOREIGN PATENT DOCUMENTS

| | | | |
|---|---|---|---|
| DE | 3241845 | A1 | 5/1984 |
| DE | 202008000491 | U1 | 3/2008 |

(Continued)

*Primary Examiner* — Robert J Hicks
*Assistant Examiner* — Kareen Thomas

(57) ABSTRACT

The present invention relates to a teat for a feeding bottle. The teat has an outer wall (18) and a plurality of recesses (25) formed in an outer wall (18). The plurality of recesses (25) extend in a circumferential arrangement around a longitudinal axis of the teat. The present invention also relates to a teat with an outer wall (5, 46, 66). The outer wall has a region of reduced wall thickness (7, 47, 67, 84) extending in a circumferential band around a longitudinal axis of the teat.

6 Claims, 6 Drawing Sheets

(56) References Cited

U.S. PATENT DOCUMENTS

| | | | | |
|---|---|---|---|---|
| 6,645,228 | B2 * | 11/2003 | Renz | A61J 11/0035 215/11.5 |
| 6,745,912 | B2 | 6/2004 | Uehara et al. | |
| 8,181,800 | B2 * | 5/2012 | Rees | A61J 11/006 215/11.1 |
| 2004/0220618 | A1 | 11/2004 | Rohrig | |
| 2006/0011572 | A1 * | 1/2006 | Pegg | A61J 11/005 215/11.1 |
| 2007/0068890 | A1 | 3/2007 | Rohrig | |
| 2007/0272645 | A1 | 11/2007 | Ito | |
| 2008/0210655 | A1 | 9/2008 | Rees et al. | |
| 2012/0074090 | A1 * | 3/2012 | Rees | A61J 11/0065 215/11.1 |

FOREIGN PATENT DOCUMENTS

| | | | |
|---|---|---|---|
| JP | 09056787 | | 3/1997 |
| JP | 2000189496 | A | 7/2000 |
| JP | 2001299877 | | 10/2001 |
| JP | 2001299878 | | 10/2001 |
| JP | 2002011076 | | 1/2002 |
| JP | 2002011076 | A | 1/2002 |
| WO | 2006000816 | A1 | 1/2006 |

* cited by examiner

TEAT FOR A FEEDING BOTTLE

FIELD OF THE INVENTION

The present invention relates to a teat for a feeding bottle. The present invention also relates to a feeding bottle for a baby including a teat.

BACKGROUND OF THE INVENTION

Many different designs of teats for feeding bottles are known. Such teats generally attempt to mimic the shape and feel of the nipple and areola of a mother's breast. During feeding a baby generally receives a nipple in their mouth and pinches the aerola with their gums. This pinching motion is known as 'latching on', and it is an important aspect to acceptance of the nipple and aerola by a baby.

A conventional teat for a baby bottle has a mouthpiece defined by a circle symmetric outer wall formed from a resilient material, such as a suitable rubber or latex material, comprising a nipple portion and an aerola portion. The outer wall of such a teat generally has a high stiffness to enable the teat to maintain its overall shape and to prevent the teat from tearing.

However, a problem with conventional teats is that babies may find it difficult to latch on to the aerola portion of the teat, because their gums cannot pinch the teat easily.

SUMMARY OF THE INVENTION

It is an object of the present invention to provide a teat for a feeding bottle which substantially alleviates or overcomes the problems mentioned above.

Accordingly, the present invention provides a teat for a feeding bottle having an outer wall and a plurality of recesses formed in the outer wall, wherein the plurality of recesses extend in a circumferential arrangement around a longitudinal axis of the teat.

Preferably, the plurality of recesses are formed in an inner surface of the outer wall of the teat.

The teat may further comprise a nipple portion and an aerola portion, the plurality of recesses being formed in the aerola portion.

An outer edge of each recess may be ovoidally shaped.

In one embodiment, each recess is spaced from an adjacent recess.

An inner face of each recess may be concave.

Advantageously, each recess is uniform in shape and/or size.

The outer wall may be resilient and deformable.

According to another aspect of the invention, there is provided a teat for a feeding bottle having an outer wall with a region of reduced wall thickness extending in a circumferential band around a longitudinal axis of the teat.

The teat may further comprise a nipple portion and an aerola portion, the region of reduced wall thickness being formed in the aerola portion.

Conveniently, a path of a border between the region of reduced wall thickness and an adjacent portion of the outer wall varies in an axial direction as the border extends around the circumference of the teat.

Preferably, the border follows a sinuous path around the circumference of the teat.

Advantageously, the path of the border has a waveform shape.

Preferably, the path of the border has a square, triangular or curved waveform shape.

Conveniently, the border between the region of reduced wall thickness and an adjacent portion of the outer wall is a first border and a second border extends around the circumference of the teat between the region of reduced wall thickness and another adjacent portion of the outer wall.

According to another aspect of the invention, there is provided a feeding bottle for a baby including a teat.

BRIEF DESCRIPTION OF THE DRAWINGS

Preferred embodiments of the invention will now be described, by way of example only, with reference to the accompanying drawings, in which.

DETAILED DESCRIPTION OF THE EMBODIMENTS

Figure 1:
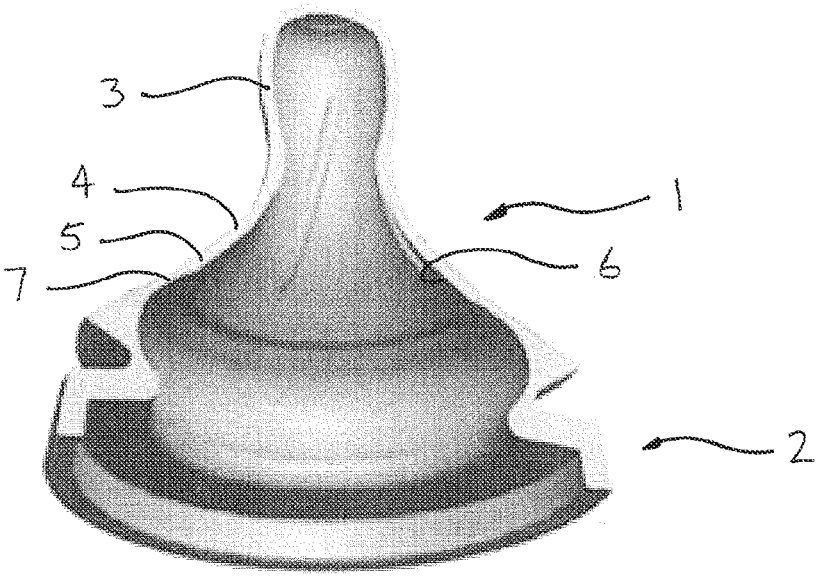
FIG. 1 shows a cross-sectional perspective view of a teat for a baby feeding bottle according to a first embodiment.
Figure 2:
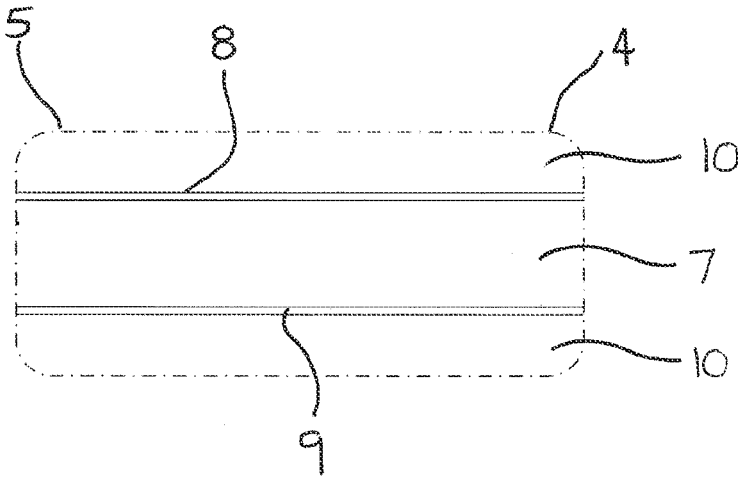
FIG. 2 shows a schematic view of part of an inner surface of the teat shown in FIG. 1.

Referring now to FIGS. 1 and 2, a teat for a feeding bottle is shown comprising a mouthpiece 1 and a mounting portion 2.

The mouthpiece 1 and mounting portion 2 of the teat have a longitudinal axis and are rotationally symmetrical about the longitudinal axis. The mouthpiece 1 and mounting portion 2 are integrally formed from a resilient material, such as a suitable rubber or latex material.

The mouthpiece 1 comprises a nipple portion 3 and an aerola portion 4 which extends from a lower end of the nipple portion 3. The aerola portion 4 comprises a rotationally symmetric, resiliently deformable outer wall 5 having an inner surface 6. The inner surface 6 of the outer wall 5 defines a milk receiving space in which milk to be expressed from the teat is contained when a feeding bottle with the teat fixedly mounted thereto is in an inverted position, so that milk flows into the teat.

One or more apertures (not shown) are formed in an upper end of the nipple portion 3 of the mouthpiece 1, and the one or more apertures communicates with the milk receiving space for the flow of milk, in use, from a feeding bottle (not shown) to which the teat is to be attached, through the aperture (not shown), and into a baby's mouth The nipple portion 3, aerola portion 4 and mounting portion 2 are integrally formed, with the aerola portion 4 diverging outwardly from the nipple portion 3 to the mounting portion 2.

The aerola portion 4 comprises a region of reduced wall thickness 7 extending in a circumferential band around a longitudinal axis of the teat. The region of reduced wall thickness 7 is formed in the inner surface 6 of the outer wall 5 of the aerola portion 4. The outer wall 5 extends circumferentially around the longitudinal axis of the teat and so the region of reduced wall thickness 7 extends in a circumferential arrangement around said axis.

The region of reduced wall thickness 7 is defined by an upper border 8, and a lower border 9. It will be appreciated that the upper and lower borders 8, 9 are a transitional zone between an adjacent portion 10 of the aerola portion 4 having a normal wall thickness and the region of reduced wall thickness 7. Therefore, each of the upper and lower borders 8, 9 may be, for example, a step, an incline or a rounded portion.

Each border 8, 9 of the region of reduced wall thickness 7 follows a path which extends around the circumference of the inner surface 6 of the aerola portion 4, and therefore the teat. The upper and lower borders 8,9 extend parallel to each other and perpendicular to the longitudinal axis of the teat.

The region of reduced wall thickness 7 formed in the outer wall 5 of the aerola portion 4 reduces the thickness of the outer wall 5 such that the flexibility of the areola portion is increased. This enables the aerola portion 4 to feel soft and flexible to a baby's mouth, and encourages a baby to latch on more easily.

In the present embodiment the region of reduced wall thickness is defined by upper and lower borders. However it will be appreciated that the region of reduced wall thickness may have a single border formed on the inner surface, with the opposing section of increased wall thickness being formed by an outer surface of the outer wall diverging outwardly.

Figure 3:
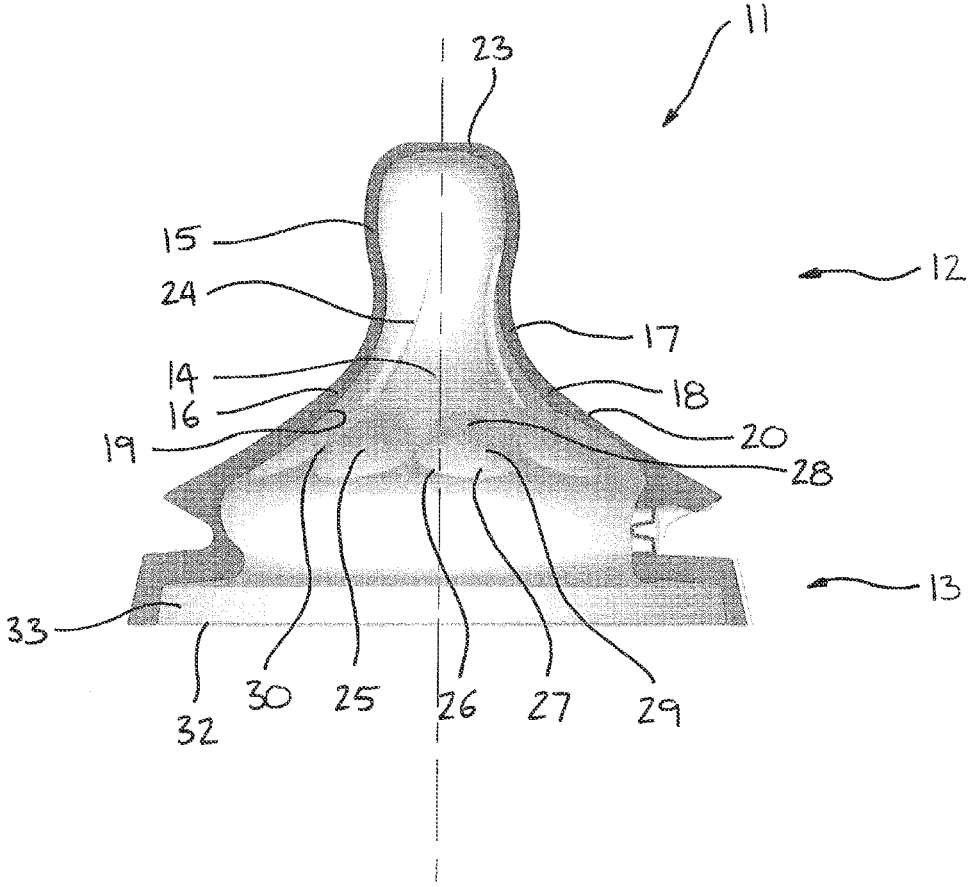
FIG. 3 shows a cross-sectional view of a teat for a baby feeding bottle according to a second embodiment.
Figure 4:
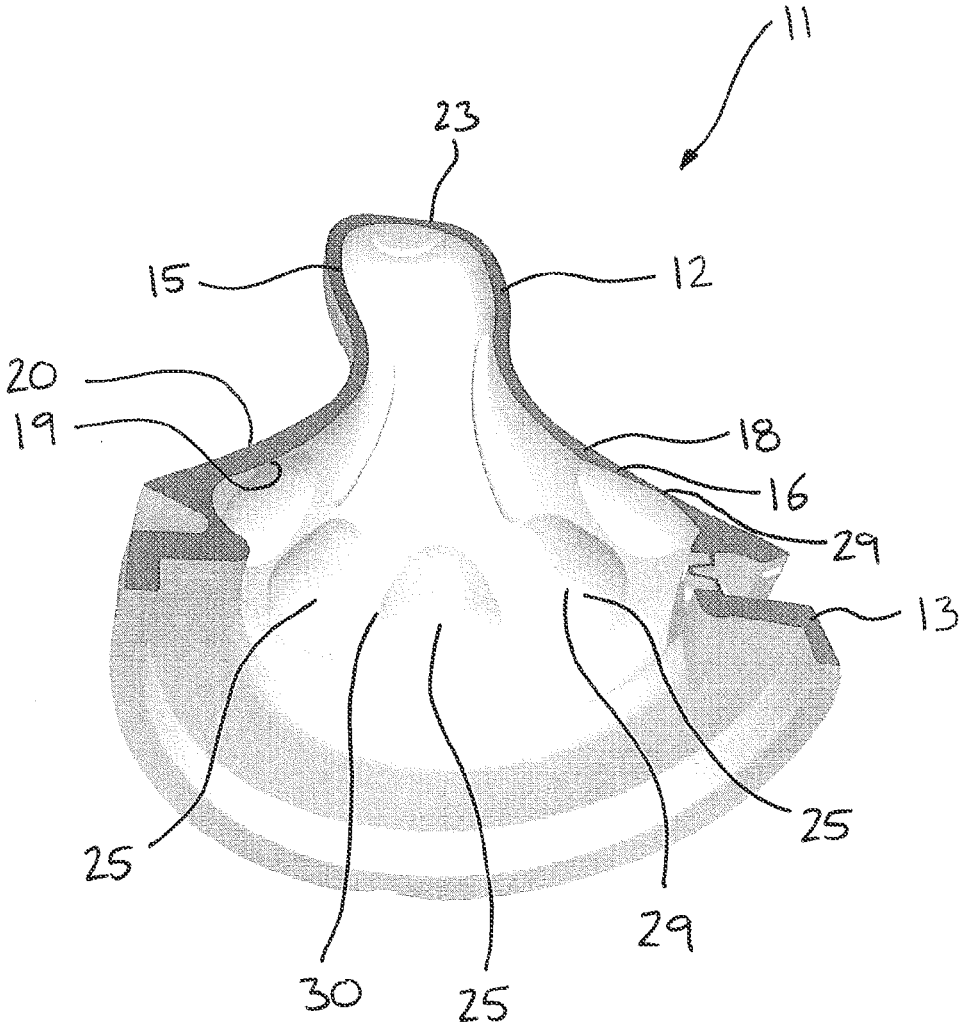
FIG. 4 shows a cross-sectional perspective view of the teat shown in FIG. 3.

Referring now to FIGS. 3 and 4, a second embodiment of a teat 11 for a feeding bottle is shown comprising a mouthpiece 12 and a mounting portion 13.

The mouthpiece 12 and mounting portion 13 of the teat 11 have a longitudinal axis and are rotationally symmetrical about the longitudinal axis. The mouthpiece 12 and mounting portion 13 are integrally formed from a resilient material, such as a suitable rubber or latex material.

The mouthpiece 12 defines a milk receiving space 14 and comprises a nipple portion 15 and an aerola portion 16 which extends from a lower end 17 of the nipple portion 15. The aerola portion 16 comprises a rotationally symmetric, resiliently deformable outer wall 18 having an inner surface 19 and an outer surface 20. The inner surface 19 of the outer wall 18 defines the milk receiving space 14 in which milk to be expressed from the teat 11 is contained when a feeding bottle with the teat fixedly mounted thereto is in an inverted position, so that milk flows into the teat 11.

One or more apertures (not shown) are formed in a distal end 23 of the nipple portion 15 of the mouthpiece 12, and the one or more apertures communicate with the milk receiving space 14 for the flow of milk, in use, from a feeding bottle (not shown) to which the teat 11 is to be attached, through the aperture (not shown), and into a baby's mouth A plurality of ribs 24 are provided in the mouthpiece 12 extending in a shallow helical arrangement to provide support and stiffness to the mouthpiece 12.

The nipple portion 15, aerola portion 16 and mounting portion 13 are integrally formed, with the aerola portion 16 diverging outwardly from the nipple portion 15 to the mounting portion 13. The cross-sectional thickness of the nipple portion 15, aerola portion 16 and mounting portion 13 gives the teat a stiffness to resist bending and teat collapse.

A plurality of recesses 25 are formed in the inner surface 19 of the outer wall 18 of the aerola portion 16. The outer wall 18 extends circumferentially around the longitudinal axis of the teat 11 and so the plurality of recesses 25 extend in a circumferential arrangement around said axis. It will be appreciated that each recess 25 forms an area of reduced thickness in the outer wall 18 of the aerola portion 16, and so the plurality of recesses 25 form a band of reduced thickness hollows extending around the longitudinal axis of the teat 11.

Each recess 25 has an ovoidally shaped outer edge 26 with a broad lower end 27 and a narrow upper end 28, wherein the narrow upper end 28 extends towards the nipple portion 15. An inner face 29 of each recess 25 is concave and so the thickness of the outer wall 18 is reduced in the area of each recess 25. Each recess 25 is separated from an adjacent recess 25 by a narrow ridge 30 in which the full thickness of the outer wall 18 is retained.

The plurality of recesses 25 formed in the outer wall 18 reduce the thickness of the outer wall 18 and so the flexibility of outer wall 18 in the region of the plurality of recesses 25 forming a circumferential band around the longitudinal axis of the teat 11 is increased compared to an outer wall without any recesses. This allows the areola portion 16 to feel soft and flexible to a baby's mouth and enables a baby to latch on more easily, whilst retaining stiffness in a direction of the longitudinal axis of the teat.

A potential problem with the first embodiment of a teat described above is that the aerola portion of the teat may bend, buckle and/or or twist in the region of reduced wall thickness extending in a circumferential band around a longitudinal axis of the teat. Therefore, the nipple of the teat may be pushed inwardly in the direction of the bottle when a baby is sucking on the teat or the feeding bottle is pushed towards the mouth of the baby. This situation is known as 'teat collapse'. However, in the above arrangement with a plurality of recesses, the outer wall 18 of the aerola portion 16 is stiff in an axial direction to restrict inversion of the teat whilst a soft and flexible feeling for a baby is also achieved.

In the present embodiment a teat 11 with nine independent recesses 25 formed in the outer wall 18 in a circumferential arrangement around the longitudinal axis of the teat 11 is shown, however it will be understood that the number of recesses is not limited thereto.

Although in the present embodiment each recess 25 has an ovidally shaped outer edge 26, it will be appreciated that the shape of each recess 25 is not limited thereto and that the recesses 25 may have an alternative shape. Furthermore, it will be appreciated that the recesses may vary in size and shape. In the present embodiment, diametrically opposing recesses (14) are uniform in shape and size to help restrict bending of the teat.

The mounting portion 13 has a circular end face 32 and a mounting collar 33 to fixedly mount the teat 11 to a feeding bottle, however such an arrangement is conventional and so no further description will be given herein.

Operation of a teat according to the above embodiment will now be described. In use, the teat 11 is attached to a feeding bottle in a known manner. The teat 11 and feeding bottle (not shown) is inverted and the mouthpiece 12 is inserted into a baby's mouth. The baby then latches onto the mouthpiece 12, and pinches the aerola portion 16 of the teat 11 with their gums. The plurality of recesses 25 provides an increased flexibility of the aerola portion 16 in the proximity of the band of recesses 25 which enables the teat 11 to feel softer to a baby and therefore encourage a baby to latch on to the mouthpiece 12 and retain a latched on position.

The baby is then able to suck the nipple portion 15, which is sufficient to cause a flow of milk from the milk receiving space 22, through the or each aperture and into the baby's mouth. The thickness of the aerola portion 16 of the teat 11 provides an increased structural stiffness to restrict the teat 11 from collapsing. The baby is then able to obtain a further flow of milk from the bottle out of the teat 11, by using a peristaltic feeding action by which a wave of compression is exerted by the baby's tongue on the mouthpiece 2.

It will be appreciated the thickness of the membrane and the size and shape of the recesses 25 are chosen and manufactured to encourage a baby to latch on.

Although the plurality of recesses 25 are formed on the inner surface 19 of the outer wall 18, it will be appreciated that the plurality of recesses 25 may be formed on the outer surface 25 of the outer wall 18.

Another advantage of the above arrangement of a teat 11 with a plurality of recesses 25 formed therein is that it is easy to clean and it gives a natural appearance which can encourage a baby to latch on.

Figure 5:
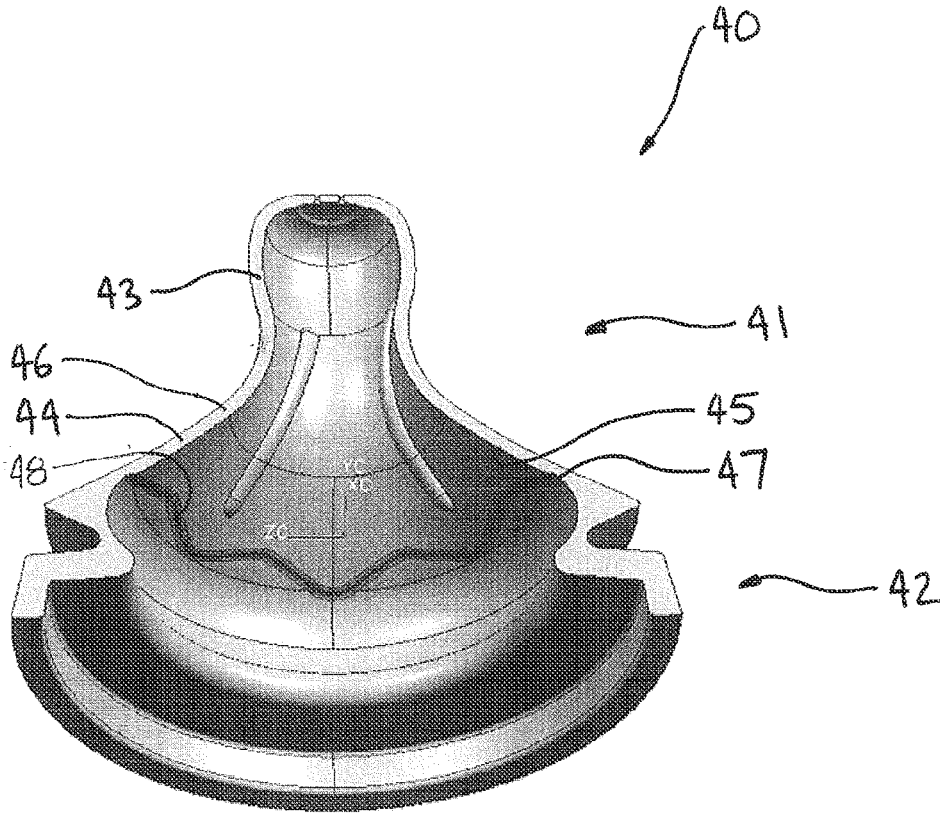
FIG. 5 shows a cross-sectional perspective view of a teat for a baby feeding bottle according to a third embodiment.
Figure 6:
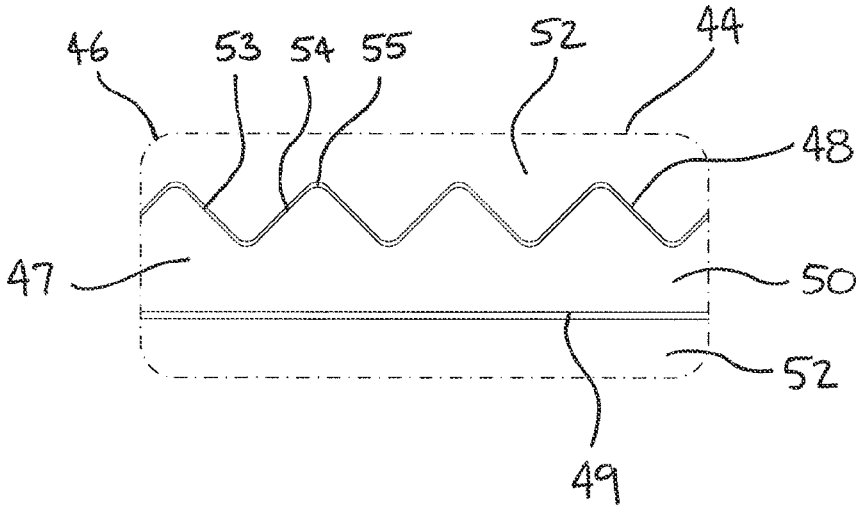
FIG. 6 shows a schematic view of part of an inner surface of the teat shown in FIG. 5.

Referring to FIGS. 5 and 6, a third embodiment of a teat 40 for a feeding bottle is shown. This embodiment of the teat 40 is generally the same as the above described embodiment of a teat 11, and so a detailed description will be omitted and so many features and components correspond to features and components of the first embodiment of a teat.

The teat 40 according to the third embodiment is shown in FIG. 5 comprising a mouthpiece 41 and a mounting portion 42 having a longitudinal axis and which are rotationally symmetrical about said longitudinal axis. The mouthpiece 41 and mounting portion 42 are integrally formed from a resilient material, such as a suitable rubber or latex material.

The mouthpiece 41 comprises a nipple portion 43 and an aerola portion 44 which extends from a lower end of the nipple portion 43. The aerola portion 44 comprises a rotationally symmetric, resiliently deformable outer wall 46 having an inner surface 45.

The nipple portion 43, aerola portion 44 and mounting portion 42 are integrally formed, with the aerola portion 44 diverging outwardly from the nipple portion 43 to the mounting portion 42. The cross-sectional thickness of the nipple portion 43, aerola portion 44 and mounting portion 42 gives the teat a stiffness to resist bending and teat collapse.

The aerola portion 44 comprises a region of reduced wall thickness 47 extending in a circumferential band around a longitudinal axis of the teat 40. The region of reduced wall thickness 47 is formed in the inner surface 45 of the outer wall 46 of the aerola portion 44. The outer wall 46 extends circumferentially around the longitudinal axis of the teat 40 and so the region of reduced wall thickness 47 extends in a circumferential arrangement around said axis.

The region of reduced wall thickness 47 is defined by an upper border 48, a lower border 49 and a base 50. It will be appreciated that the upper and lower borders are a transitional zone between an adjacent portion 52 of the inner surface 45 of the aerola portion 44 and the region of reduced wall thickness 47. Therefore, the cross-sectional arrangement of each of the upper and lower borders 48, 49 may, for example, be a step, an incline or a rounded portion. Each border 48, 49 of the region of reduced wall thickness 47 follows a path which extends around the circumference of the inner surface 45 of the aerola portion 44, and therefore the teat.

The path of each border 48, 49 of the region of reduced wall thickness 47 extends around the outer wall to form a continuous loop. Referring to the drawings, in particular to FIG. 6, the path of the upper border 48 between the region of reduced wall thickness 47 and an adjacent portion 52 of the outer wall 46 varies in an axial direction as the border extends around the circumference of the teat.

The path of the upper border 48 extending circumferentially around the outer wall 46 has a serrated arrangement with saw toothed edges. First edges 53 of the upper border extend at an angle to adjacent second edges 54. Corners 55 of the border are curved. The upper border 48 has a uniform profile extending circumferentially around the outer wall 46 of the aerola portion 44.

The path of the lower border 49 extending circumferentially around the outer wall 46 extends perpendicular to the longitudinal axis of the teat without any curves or bends, and so the path of the lower border 49 does not vary in an axial direction.

The aerola portion 44 therefore has a first circumferentially extending section 56 having a band of reduced wall thickness, and a second circumferentially extending section 57 having a band with portions of reduced wall thickness and normal wall thickness. This arrangement increases the stiffness of the aerola portion 44 in a vertical direction to restrict teat collapse by minimizing the width of the first circumferentially extending section 76 having a band of reduced wall thickness, but also enables the aerola portion 44 to feel soft and flexible to a baby's mouth.

Figure 7:
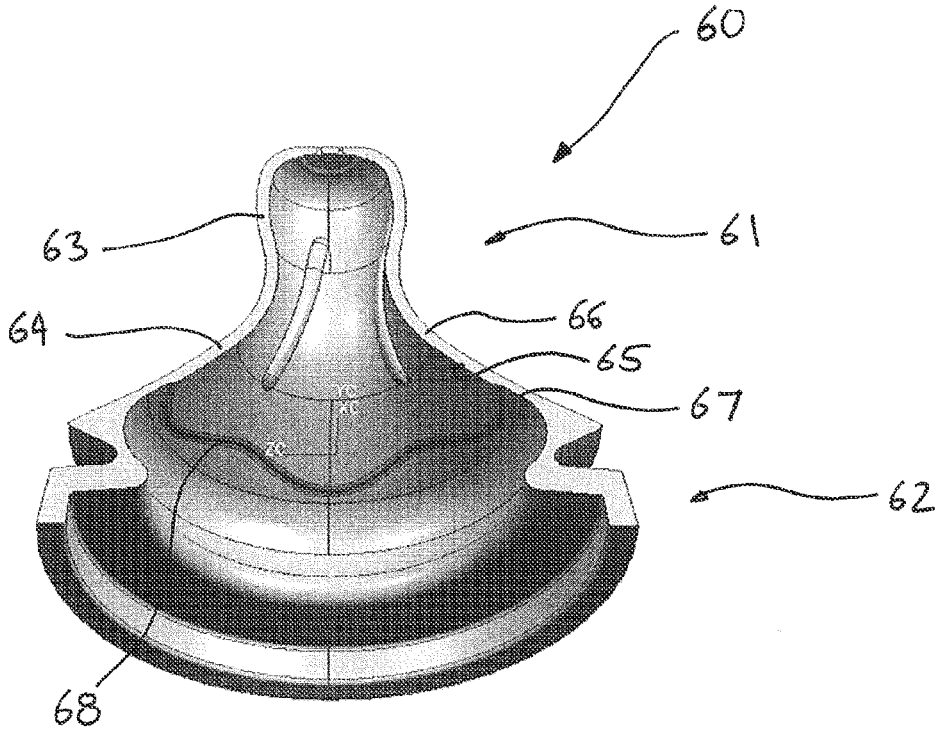
FIG. 7 shows a cross-sectional perspective view of a teat for a baby feeding bottle according to a fourth embodiment.
Figure 8:
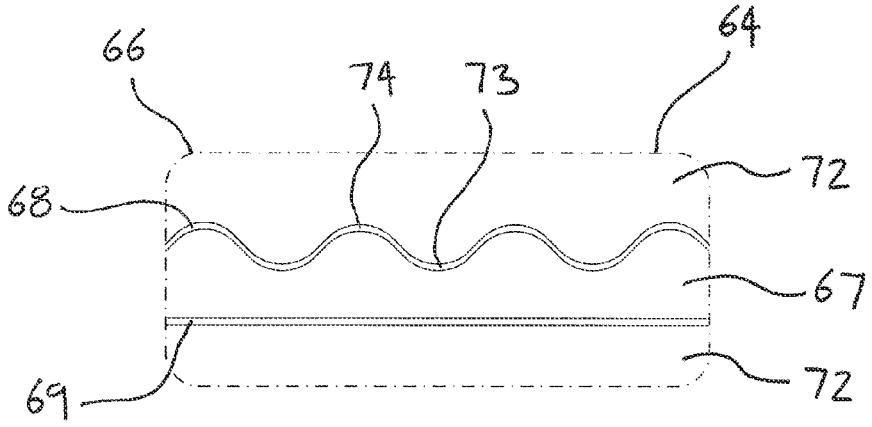
FIG. 8 shows a schematic view of part of an inner surface of the teat shown in FIG. 7.

Referring to FIGS. 7 and 8, a fourth embodiment of a teat 60 for a feeding bottle is shown. This embodiment of the teat is generally the same as the above described third embodiment of a teat 40, and so a detailed description will be omitted and many features and components correspond to features and components of the first embodiment of a teat.

The teat 60 according to the fourth embodiment is shown in FIG. 7 comprising a mouthpiece 61 and a mounting portion 62 having a longitudinal axis and which are rotationally symmetrical about said longitudinal axis. The mouthpiece 61 and mounting portion 62 are integrally formed from a resilient material, such as a suitable rubber or latex material.

The mouthpiece 61 comprises a nipple portion 63 and an aerola portion 64 comprising a rotationally symmetric, resiliently deformable outer wall 66 having an inner surface 65.

The aerola portion 64 comprises a region of reduced wall thickness 67 extending in a circumferential band around a longitudinal axis of the teat 60. The region of reduced wall thickness 67 is formed in the inner surface 65 of the outer wall 66 of the aerola portion 64. The outer wall 66 extends circumferentially around the longitudinal axis of the teat 60 and so the region of reduced wall thickness 67 extends in a circumferential arrangement around said axis.

The region of reduced wall thickness 67 has an upper border 68 and a lower border 69. It will be appreciated that the upper and lower borders 68, 69 are a transitional zone between an adjacent portion 72 of the inner surface 65 of the aerola portion 64 and the region of reduced wall thickness 67. Each border 68, 69 of the region of reduced wall thickness 67 follows a path which extends around the circumference of the inner surface 65 of the aerola portion 64, and therefore the teat 60.

The path of each border 68, 69 of the region of reduced wall thickness 47 extends circumferentially around the aerola portion to form a continuous loop. Referring to the drawings, in particular to FIG. 8, the path of the upper border 68 between the region of reduced wall thickness 67 and an adjacent portion 72 of the outer wall 66 varies in an axial direction as the upper border 68 extends around the circumference of the teat 60.

The path of the upper border 68 extending circumferentially around the outer wall 66 has a curved wave arrangement with opposing peaks and troughs 73, 74. The upper border 68 has a uniform profile extending circumferentially around the outer wall 66 of the aerola portion 64.

The path of the lower border 69 extending circumferentially around the outer wall 66 extends perpendicular to the longitudinal axis of the teat without any curves or bends, and so the path of the lower border 69 does not vary in an axial direction.

The aerola portion 64 therefore has a first circumferentially extending section 76 having a band of reduced wall thickness, and a second circumferentially extending section 77 having a band with portions of reduced wall thickness and normal wall thickness. This arrangement increases the stiffness of the aerola portion 64 in a vertical direction to restrict teat collapse by minimizing the width of the first circumferentially extending section 76 having a band of reduced wall thickness, but also enables the aerola portion 64 to feel soft and flexible to a baby's mouth.

Although in each of the above third and fourth embodiments of a teat 40, 60 the path of the lower border does not vary in an axial direction as it extends circumferentially around the teat, whereas the path of the upper border does vary in an axial direction as it extends circumferentially around the teat, it will be appreciated that in an alternative embodiment the path of the lower border varies in an axial direction as it extends circumferentially around the teat and the path of the upper border does not vary.

Figure 9:
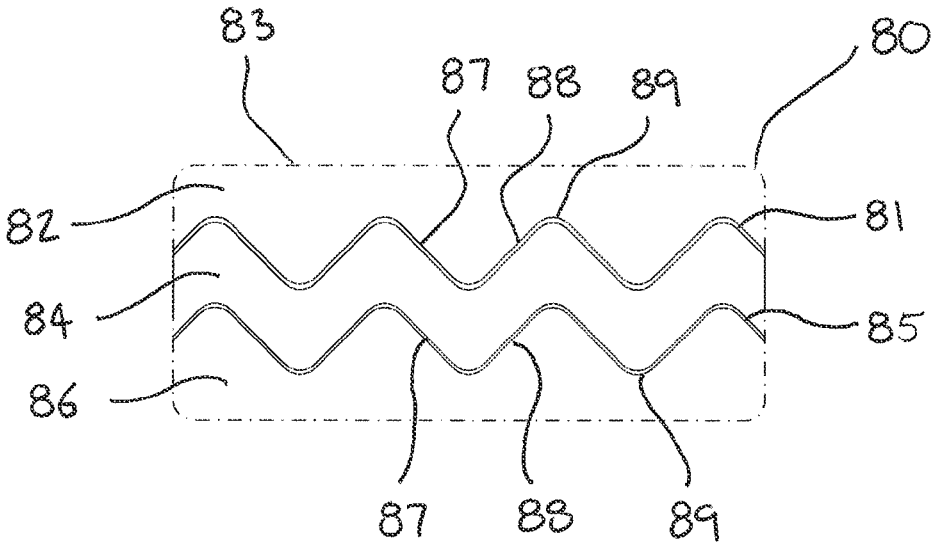
FIG. 9 shows a schematic view of part of an inner surface of a teat for a baby feeding bottle according to a fifth embodiment.

Although in each of the above third and fourth embodiments of a teat 40, 60 the path of the lower border does not vary in an axial direction as it extends circumferentially around the teat, it will be appreciated that in alternative embodiments the upper and lower borders may vary in an axial direction as they extend circumferentially around the teat. Such an arrangement is shown in FIG. 9. This fifth embodiment of a teat 80 for a baby feeding bottle is generally the same as the third embodiment of a teat 40 for a baby feeding bottle described above, and therefore a detailed description of the teat 80 will be omitted herein. However, in this fifth embodiment of the teat 80 a lower border between an adjacent portion of the inner surface of the aerola portion and the region of reduced wall thickness varies in an axial direction as it extends around the circumference of the teat.

Referring to FIG. 9, an upper border 81 is defined between a first adjacent portion 82 of the inner surface of the aerola portion 83 and a region of reduced wall thickness 84. Similarly, a lower border 85 is defined between a second adjacent portion 86 of the inner surface of the aerola portion 83 and the region of reduced wall thickness 84.

In this embodiment, the paths of the upper and lower borders 81, 85 each have a serrated arrangement with first edges 87 extending at an angle to adjacent second edges 88, together with curved corners 89. The upper and lower borders 81, 85 are spaced from each other and extend parallel to each other such that a constant width of the region of reduced thickness 84 is maintained around the longitudinal axis of the teat 80. An advantage of the above arrangement, is that the first and second adjacent portions 82, 86 of the aerola portion 83 having a normal wall thickness extend to each other, or overlap, in an axial direction and so teat collapse is further restricted.

In the above embodiments the region of reduced wall thickness is defined by upper and lower borders. However it will be appreciated that the region of reduced wall thickness may have a single border formed on the inner surface, with the opposing section of increased wall thickness being formed by the outer surface of the outer wall diverging outwardly.

It will be appreciated that in each of the above described third to fifth embodiments the path of the border between the region of reduced wall thickness and an adjacent portion of the outer wall follows a sinuous path wherein, the border has many curves, bends or turns as it extends around the inner surface of the outer wall.

In each of the above described third to fifth embodiments the border follows a waveform shaped path around the circumference of the inner surface of the outer wall, and it will be appreciated that the border may follow, for example, a triangular waveform path, a regular curved waveform path or a square waveform path.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. A teat for a feeding bottle having an outer wall and a plurality of recesses formed in an inner surface of the outer wall, wherein the plurality of recesses extend in a circumferential arrangement in a single row around a longitudinal axis of the teat, wherein each of the recesses has an ovoidally shaped outer edge with a broad lower end and a narrow upper end, wherein the narrow upper end extends towards a nipple portion of the teat, and further wherein each recess is spaced from an adjacent recess by a ridge, each ridge extending along the longitudinal axis of the teat.

2. A teat according to claim 1, further comprising an aerola portion, the plurality of recesses being formed in the aerola portion.

3. A teat according to claim 1, wherein an inner face of each recess is concave.

4. A teat according to claim 1, wherein each recess is uniform in shape.

5. A teat according to claim 1, wherein each recess is uniform in size.

6. A feeding bottle for a baby including a teat according to claim 1.

* * * * *